United States Patent [19]

Kume et al.

[11] Patent Number: 4,982,239

[45] Date of Patent: Jan. 1, 1991

[54] IMAGE FORMING APPARATUS HAVING RECIPROCATING CLEANING MEANS

[75] Inventors: Nobuyuki Kume, Yokohama; Yoshihiro Murasawa, Kawasaki, both of Japan

[73] Assignee: Canon Kabushiki Kaisha, Tokyo, Japan

[21] Appl. No.: 227,765

[22] Filed: Aug. 3, 1988

[30] Foreign Application Priority Data

Aug. 7, 1987 [JP] Japan ..... 62-196235
Jul. 22, 1988 [JP] Japan ..... 63-184095

[51] Int. Cl.[5] ..... G03G 21/00
[52] U.S. Cl. ..... 355/297; 15/256.53; 355/299
[58] Field of Search ..... 355/3 R, 15, 296, 297, 355/299, 301; 15/256.53

[56] References Cited

U.S. PATENT DOCUMENTS 3,740,789 6/1973 Ticknor ..... 15/256.53
3,838,472 10/1974 Oriel ..... 355/15 X
3,854,814 12/1974 Jones ..... 15/256.53 X
4,502,779 3/1985 Kajita et al. ..... 15/256.53 X
4,595,280 6/1986 Tanzawa et al. ..... 355/15

*Primary Examiner*—Fred L. Braun
*Attorney, Agent, or Firm*—Fitzpatrick, Cella, Harper & Scinto

[57] ABSTRACT

An image forming apparatus having a moving image bearing member on which a latent image is formed and developed into a visible image and a reciprocating cleaning device, such as a blade or roller, arranged to press against the surface of the image bearing member and reciprocate in a direction transverse to its movement. A suitable expendient is provided to change the reciprocating motion, e.g. by stopping it, slowing it or increasing its stroke, during latent image formation to minimize vibrations and resultant image blurs while providing good cleaning.

27 Claims, 7 Drawing Sheets

IMAGE FORMING APPARATUS HAVING RECIPROCATING CLEANING MEANS

BACKGROUND OF THE INVENTION

1. Field of the Invention

This invention relates to an image forming apparatus wherein a moving image bearing member is cleaned by cleaning means held in contact therewith and wherein the cleaning means is also reciprocated in the longitudinal direction, i.e. transverse to the direction of movement of the image bearing member.

2. Description of the Prior Art

Image forming apparatus are known in which a sheet-like transfer material, such as paper, is brought into contact with the surface of an image bearing member on which a transferable toner image is formed. The toner image is transferred onto the transfer material in an electrostatic manner, and then the transfer material is separated from the image bearing member; and the above steps are repeated as necessary each time these steps are carried out it is required to remove the residual toner which has made no contribution to the transfer step and still remains on the surface of the image bearing member even after separation of the transfer material.

Therefore, various means for removing the residual toner have been proposed and put into practice. It is also well known to utilizer a plate-like cleaning blade made of an elastic material such as urethane rubber and having one edge, which is held in pressure contact with the image bearing member for scraping off the residual toner. This arrangement is simple in construction and small in size; and at the same time it provides excellent toner removing capability.

However, even such cleaning means is subject to several drawbacks. Firstly the toner accumulated at the edge portion may not fall and, after long use may become solidified and lift up the blade, thereby reducing its cleaning capability. Secondly the accumulated toner may deposit and fuse onto the image bearing member, and thereby degrade the image quality.

As means for removing deposits on the photoreceptor surface, it is also known to provide an elastic roller or the like comprising a sponge layer and an elastic rubber material coated thereon. The elastic roller is particularly effective in removing the products attendant on corona discharge produced at chargers, paper dust, etc. which, in conditions of high humidity may cause the image to run. However, since the elastic roller is moved to slide on the photoreceptor surface while maintaining highly pressurized contact therewith, scratches in the form of streaks are in the circumferential direction of the photoreceptor, and hence undesired streaks emerge, thereby degrading the image quality.

To avoid the foregoing drawbacks, it is also proposed to reciprocate the cleaning blade or elastic roller in the longitudinal direction thereof with an appropriate stroke. With this technique, a kind of stimulus is given to the toner particles for preventing the toner from being accumulated and also preventing foreign matter from being deposited. In case of using the elastic roller, the above technique is likewise effective in preventing the streak scratches in the circumferential direction of the photoreceptor. For example, Japanese Patent Laid-Open No. 62-105181(1987) discloses one type of cleaning blade which is reciprocated in the longitudinal direction of the image bearing member.

However, when the cleaning blade or the elastic roller is reciprocated, the photoreceptor and other components necessarily are more susceptible to vibrations particularly at the time of turning in the direction of movement, which may result in degraded image quality due to blurs or the like. Above all, in the case of laser printers, digital reproduction machines, and digital color reproduction machines, where a minute spot of laser beam is scanned on the photoreceptor surface for forming a latent image, spot positions are often so drifted that the latent image is disordered and the image quality is degraded. Especially, in full color reproduction machines, where development of respective colors is carried out onto a photoreceptor several times, and a toner image in each color is repeatedly transferred onto a transfer material held on a transfer material bearing member (hereinafter referred to as a transfer drum), vibrations due to reciprocal movement of the cleaning blade or elastic roller cause transfer shifts, resulting in the degraded image quality.

SUMMARY OF THE INVENTION

This invention has been accomplished in view of the foregoing, and has for an object to provide an image forming apparatus in which cleaning means is reciprocated with respect to an image bearing member in a manner to inhibit the image bearing member from vibrating as much as possible, while maintaining the advantage of such reciprocation.

Another object of this invention is to provide an image forming apparatus with which a satisfactory image with no blurs can be produced by inhibiting the occurrence of vibrations of the image bearing member, and which is particularly effective in making the best use of characteristics of the apparatus capable of producing highly fine images.

According to one aspect of the invention there is provided in an image forming apparatus a moving image bearing member, a moving image forming means for forming an image on the surface of the image bearing member, cleaning means held in contact with the image bearing member for cleaning its surface, reciprocating means for reciprocating the cleaning means in a direction transverse to the movement of the image bearing member and control means constructed and arranged to control the operation of the reciprocating means and thereby change the operating status of the cleaning means. In more specific aspects, the control means is constructed and arranged to change the reciprocating motion of the cleaning means during a period other than that in which the latent image is formed on the image bearing member. Such changes may comprise, according to certain specific features, changes in the reciprocating speed or in the stroke of the cleaning means.

According to another aspect of the invention there is provided a novel method for cleaning a moving image bearing member in an image forming apparatus. This novel method comprises the steps of holding cleaning means in contact with the image bearing member, reciprocating the cleaning means in a direction transverse to the direction of movement of the image bearing member and changing the reciprocation of the cleaning means to minimize vibration of the image bearing member while it receives a latent image.

Other objects and features of this invention will be more apparent by reading the following detailed description with reference to the accompanying drawings.

DETAILED DESCRIPTION OF THE PREFERRED EMBODIMENTS

Preferred embodiments of this invention will be described below with reference to the drawings.

Figure 3:
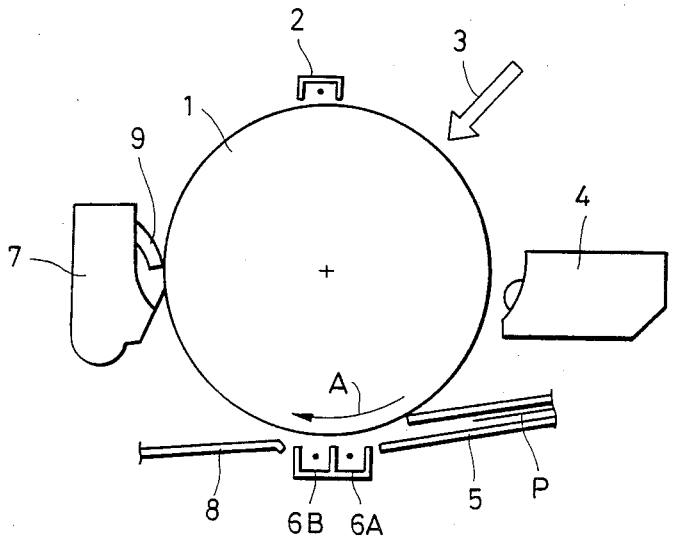
FIG. 3 is a schematic view showing a laser beam printer to which this invention is applied.

FIG. 3 is a schematic side view of a laser printer utilizing the electrostatic transfer process, for which this invention is suitably used.

A photosensitive layer on the surface of an image bearing member 1, extending in the direction normal to the drawing sheet and rotatable in the direction of an arrow a, is uniformly charged by a primary charger 2. A laser beam 3, modulated in response to an electric signal which has resulted from conversion of image information, is irradiated by a laser beam scanner onto the charged surface of the image bearing member so that an electrostatic latent image is formed thereon. Here, an LED array or liquid crystal shutter array may instead be used for irradiation instead of a laser beam.

Toner is supplied from a developer 4 to the latent image for converting the latent image into a visible toner image. The toner image is then transferred onto a transfer material P under the action of a transfer charger 6A, the transfer material P being transported through a transporter path 5 in timing with the toner image. Thereafter, the transfer material is separated from the image bearing member by transfer material separation charger 6B and then transported along the transporter path 8 to the next step.

In such a laser printer, a cleaner 7 is disposed downstream of the transfer station and includes therein a cleaning blade 9 which can reciprocate in its axial direction (in the direction normal to the drawing sheet and transverse to the direction of movement of the image bearing member) while keeping pressure contact with the image bearing member 1.

Figure 2:
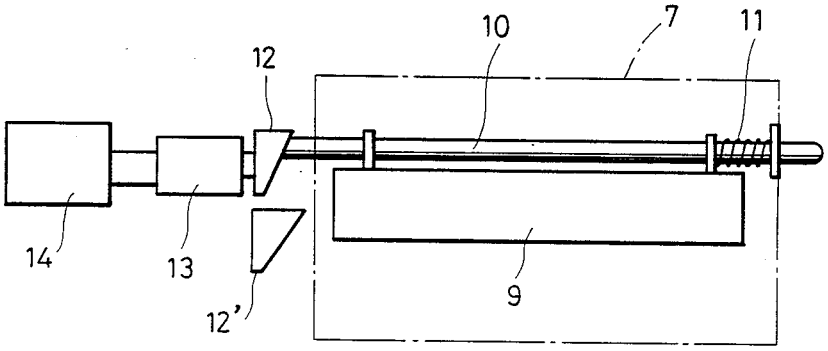
FIG. 2 is a schematic view showing one example of arrangement adapted to control reciprocal movement of a cleaning blade according to an embodiment of this invention.

FIG. 2 illustrates one example of means for reciprocating the blade 9. The cleaning blade 9 in the cleaner 7 outlined by chain lines is supported by a shaft 10' which is normally urged by a spring 11 leftward as shown.

The shaft 10' has its left end in contact with a cam 12, which is driven by a motor 13 in turn controlled by a control circuit 14, so that the blade 9 is reciprocated by movement of the shaft left and right, as viewed in FIG. 2.

Figure 1:
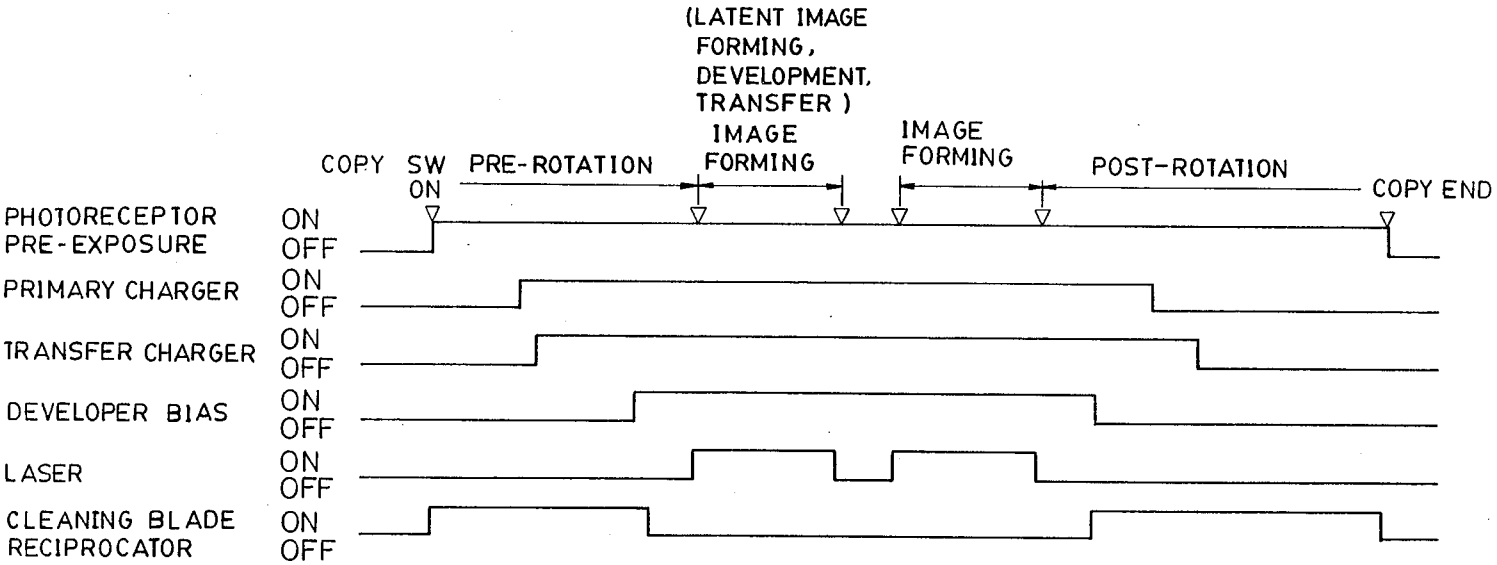
FIGS. 1, 5, 6 and 7 are charts showing timing sequences according to embodiments of this invention.

Respective components of the foregoing apparatus are operated according to the timing sequence shown in FIG. 1.

FIG. 1 represents the case of forming two images successively, in which the blade 9 (FIG. 2) is reciprocated only during pre-rotation and post-rotation of the apparatus, and is stopped during the process of image forming. Here, the process of image forming includes all steps of latent image forming, development and transfer.

An experiment was carried out using an amorphous silicon (a-Si) photoreceptor of 80 $\phi$ as an image bearing member, with a circumferential speed of 180 mm/sec, a blade pressure of 20 gr/cm, a reciprocating stroke (movable distance) of 2 mm, and a stroke speed of 3 mm/sec.

From the above experiment, it was found possible to prevent a reduction in resolution and pitch variation in the half-tone region otherwise caused by reciprocating motion of the blade.

Figure 4:
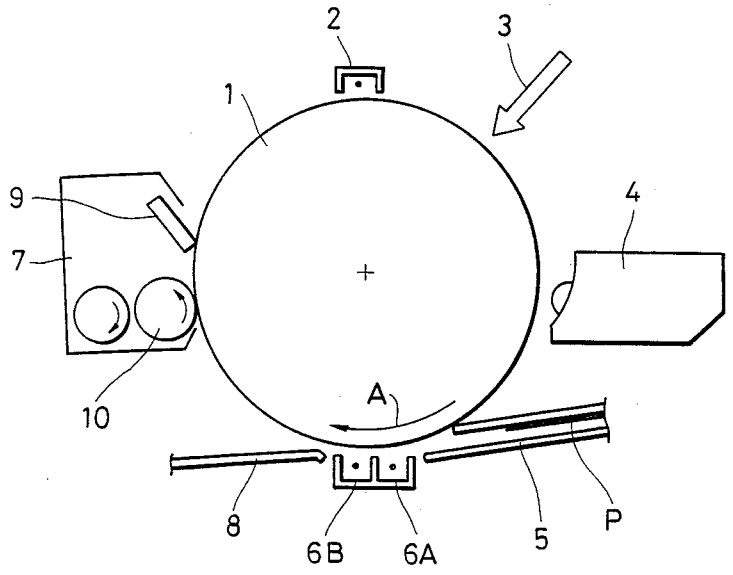
FIG. 4 is a schematic view of an image forming apparatus in which a cleaner has a blade and a roller, according to another embodiment of this invention.
Figure 5:
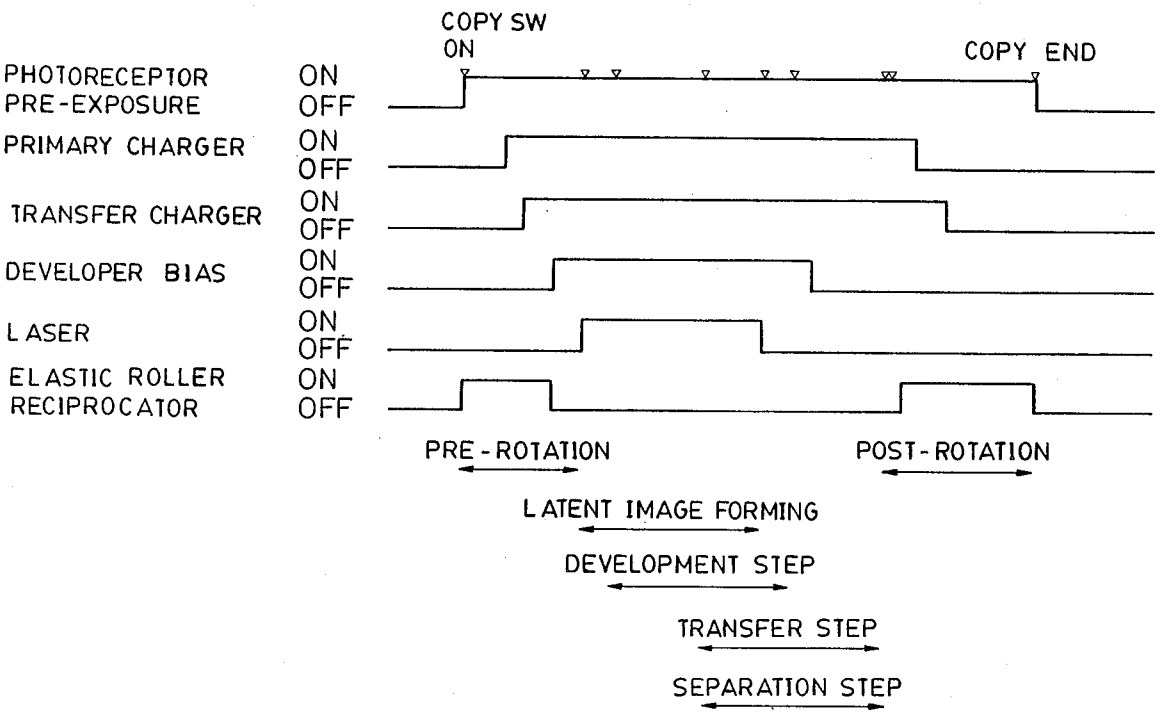

FIG. 4 illustrates another example of the cleaner 7 in which the cleaning blade 9 and an elastic roller 10 disposed upstream of the blade 9 in the direction of movement of the photoreceptor 1 are both brought into pressure contact with the photoreceptor 1. The elastic roller 10 is designed such that it can rotate in the direction of an arrow A and can also reciprocate in its axial direction in a like manner to the blade shown in the previous example. The elastic roller 10 is particularly effective in removing the products attendant on to corona discharge produced at chargers, paper dust, etc. which may cause the image to run under conditions of high humidity. FIG. 5 depicts the timing sequence of reciprocating motion of the elastic roller 10.

FIG. 5 represents the case of forming one image, in which the elastic roller is reciprocated only during pre-rotation and post-rotation of the apparatus, and is stopped during the process of image forming (i.e., during all steps of latent image forming, development and transfer).

An experiment was carried out using an a-Si photoreceptor of 80 $\phi$ as an image bearing member, with a circumferential speed of 180 mm/sec. The elastic roller had an outer diameter of 18 $\phi$ and was brought into pressure contact with the photoreceptor under a pressing force of 60 g/cm per unit length of the roller, while being rotated at a circumferential speed of about 160 mm/sec. The elastic roller 10 was also reciprocated with a stroke of 2 mm and a speed of 0.5 mm/sec. The roller used was composed of a core metal of 6 $\phi$, a sponge layer formed on the core metal, and a surface layer made of urethane rubber having a hardness of 50° (JIS A) and coated over the sponge layer.

From the above experiment, it was found possible to prevent reduction in resolution, pitch variations in the half-tone region, and blurs of the image otherwise caused by reciprocating motion of the blade.

Although both the blade 9 and the elastic roller 10 are employed for cleaning the image bearing member, cleaning can also be effected using the elastic roller 10 alone.

Figure 6:
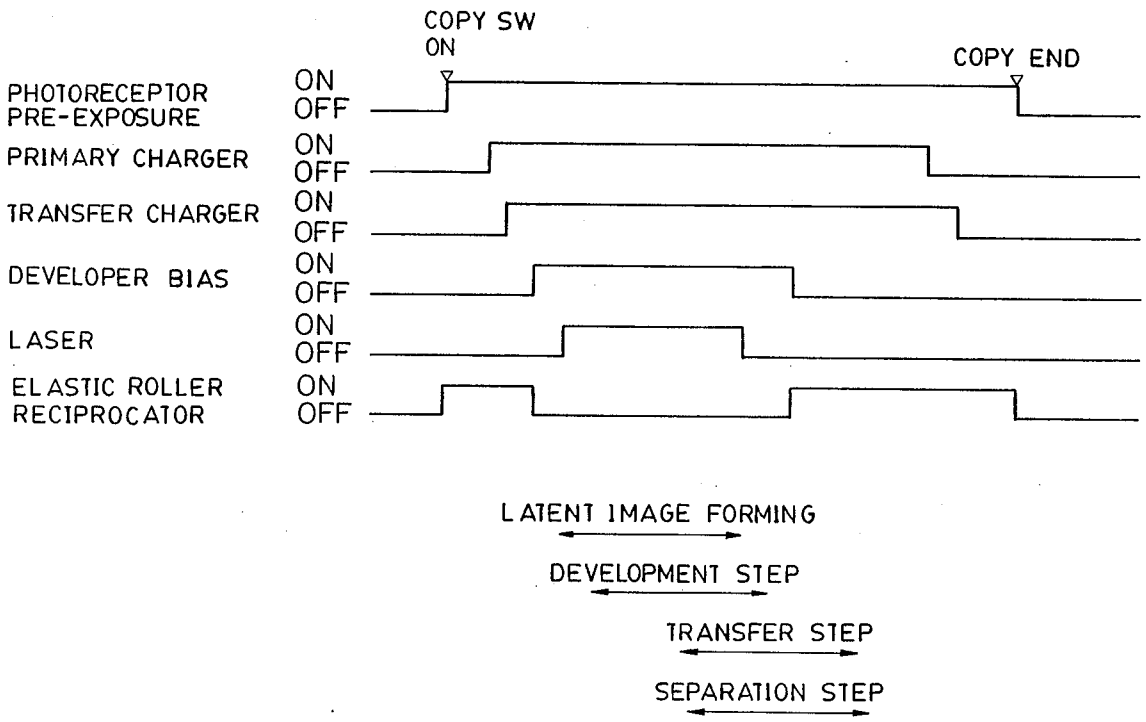

Referring to FIGS. 1 and 5, reciprocating motion of the blade 9 or elastic roller 10 is restarted after the transfer step, but the reciprocating motion may start after the development step so long as transfer shifts or the like will not occur and hence the image quality will not be affected adversely during the transfer step. As an alternative, if there is no possibility of image blurs being caused during the development step, the reciprocating motion may be restarted after the step of latent image forming. FIG. 6 depicts an example in which the reciprocating motion is restarted after the development step.

Figure 7:
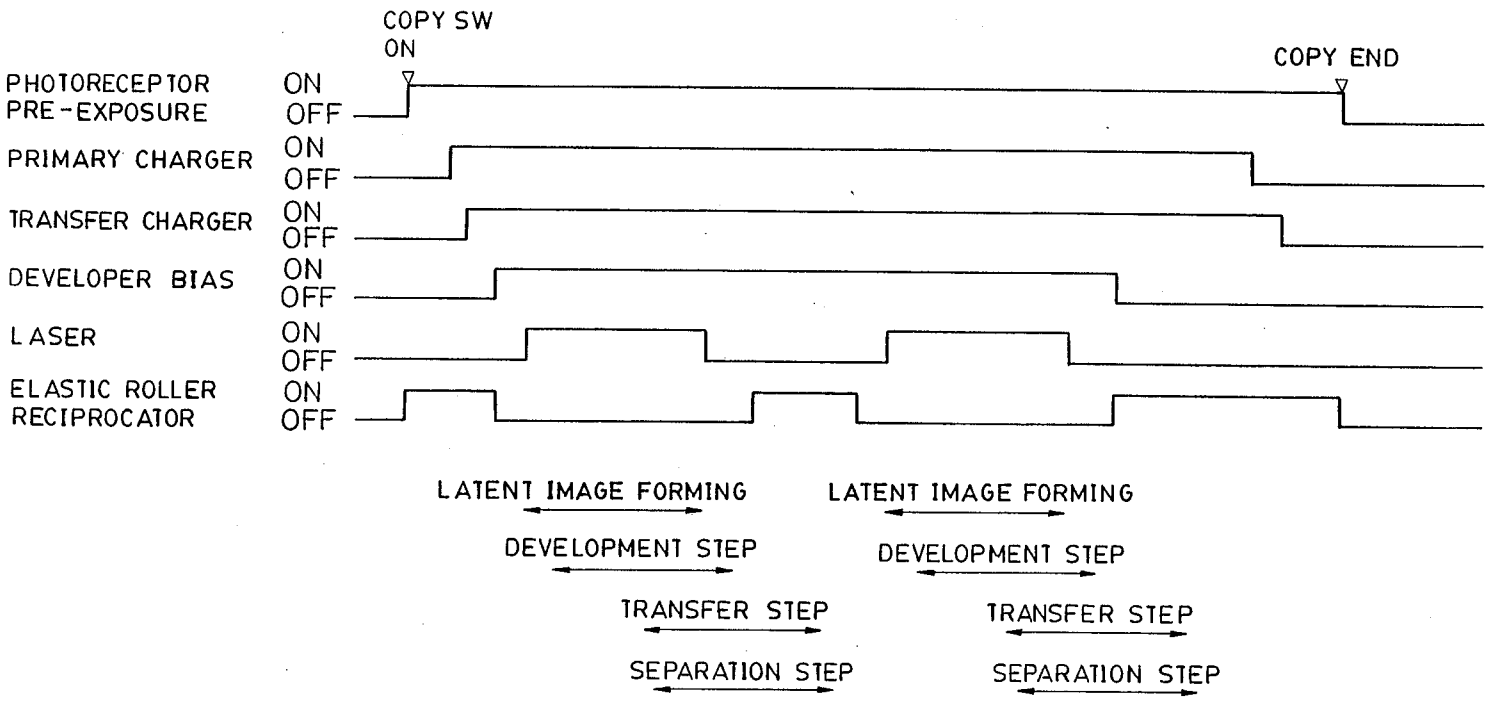

In the embodiment of FIG. 1, the blade 9 is stopped during the period between one image forming process and the next image forming process effected on the photoreceptor in a successive copying mode. However, so long as the image quality will not be affected adversely, the blade 9 or elastic roller 10 may be further reciprocated during the period from the end of developing for the first sheet to the start of latent image formation for the second sheet as shown in FIG. 7 by way of example.

In the foregoing embodiments, upon the possible occurrence of any adverse effects upon the image quality, the blade 9 or the elastic roller 10 is stopped in its reciprocating motion. However, where the cleaning capability is lowered by stopping the reciprocating motion, the blade 9 or elastic the roller 10 may be reciprocated continuously, but at a reduced speed, in place of total stopping. In accordance with the experiments, good results were obtained by setting the reciprocating speed to be 3 mm/sec during the non-image forming process and 1 mm/sec during the image forming process.

Alternatively, in place of stopping the reciprocating motion of the blade 9 or the elastic roller 10, the stroke through which the blade or roller is reciprocated during the image forming process can be set to be longer than that which occurs during the non-image forming process while the speed of the reciprocating motor is not changed. This reduces the times of turnings in the direction of reciprocating motion, thereby allowing the apparatus to undergo less vibration and other shocks at each time of turnings. Such changes in the stroke of the blade or roller can easily be performed made by using switch means (not shown) adapted to switch the cam 12 (FIG. 2) to another cam 12' which has a different slope from that of the cam 12.

In addition, since foreign material deposited on the blade edge is removed more effectively with higher reciprocating speeds of the blade and larger times of reciprocation, it is preferable that the reciprocating speed be lowered and that the reciprocating stroke be increased during the image forming process to thereby reduce the times of reciprocations (for example, in FIG. 2 when motor speed is lowered and cam 12 is switched to cam 12'); while the speed is raised and the stroke is reduced during the non-image forming process to thereby increase the times of reciprocation.

It will be apparent to those skilled in the art that the foregoing modifications for changing sequence of movement of the blade 9 or elastic roller 10 can easily be made for the control means as shown in FIG. 2 as well, by changing the speed of the motor 13 in response to a control signal output from the control circuit 14 in any known manner.

Alternatively, the pressing force of the elastic roller 10 against the photoreceptor 1 in the foregoing embodiments may be set to be smaller during the image forming process than during the non-image forming process.

Figure 8:
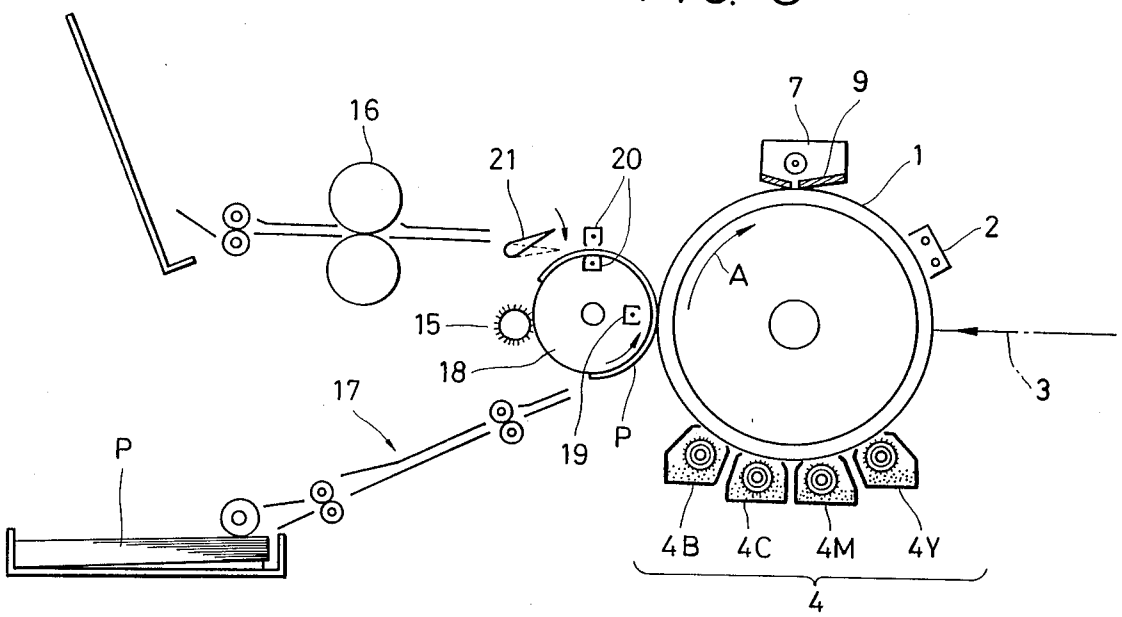
FIG. 8 is a schematic view of a full color reproduction machine to which this invention is applied.

FIG. 8 is a schematic view of a full color image reproduction machine to which this invention is applied. A charger 2 and an exposure device 3 are disposed around a photoreceptor 1. Also, in a like manner to the foregoing embodiments, an electrostatic latent image is formed on the photoreceptor 1 through an electrophotographic process. The latent image is developed by a developer 4 comprising a plurality of development units 4Y(yellow), 4M(magenta), 4C(cyan) and 4B(black) which respectively contain developing materials in different colors, so that the latent image is made visible on the photoreceptor 1.

On the other hand, a transfer material P, such as transfer paper, is supplied by a paper feed means 17 to a transfer drum 18. The visualized toner image on the drum 18 transferred by a transfer charger 19 onto the transfer material P which is pressed against the transfer drum. Here, in case of full color copying, the development and transfer steps are repeated four times (for 4 colors) such that the toner image in the first color is first developed on the photoreceptor and transferred onto the transfer material, the toner image in second color is then developed and transferred, and so on.

After the transfer operations are completed, the attraction force between the transfer material and the transfer drum 18 is lessened by a charge eliminator 20 so that the transfer material is separated from the transfer drum 18 by a separation pawl 21. Then, a fuser 16 heats and permanently fuses the toner image to the transfer material.

The photoreceptor is cleaned by a cleaning blade 9 of a cleaner 7 for each development of one color. The transfer drum 18 is provided with a brush 15 for cleaning the scattered toner, etc.

As mentioned above, in case of full color copying, the development and transfer steps are repeated for each color, and copying is completed upon superposition of four colors. Therefore, to prevent reduction in image quality, vibrations, transfer drifts or shifts onto the transfer material, etc. must be eliminated to to a greater extent than is necessary in the case of monochrome reproduction machines.

In such full color copying, the image quality can also be maintained by operating the cleaning blade 9 for each of four colors in accordance with timing sequences similar to those described in connection with the foregoing embodiments. Of course, this equally applies to the full color reproduction machines which includes an elastic roller in addition to the cleaning blade 9. Thus, as required, the reciprocating motion of the cleaning blade or elastic roller may be stopped, lowered in speed, or increased in the stroke until the transfer material becomes separated from the transfer drum.

Further, it is a matter of course that although the invention has been described by referring to digital reproduction machines in which the latent image is formed using a laser beam, it is also applicable to analog reproduction machines in which the latent image is formed using a lamp.

In the foregoing embodiments, amorphous silicon is employed as a photosensitive material for the image bearing member. This material has superior durability and hence may be expected to properly function over a long term of service. Therefore, this invention which can improve the cleaning capability of a reciprocating blade or an elastic roller, is suitable for use with an image bearing member made of amorphous silicon which is to be used for a long term operation. However, the image bearing member need not be amorphous silicon, and instead, it may be formed of a photosensitive material such as ZnO, Cds, Se, OPC (Organic Photo Conductor), etc.; or it may be constituted by an insulating drum with no photosensitive layer.

Although the blade or roller is used as means for cleaning the image bearing member in the illustrated embodiments, a brush may also be used.

Further, in the illustrated embodiments, reciprocating motion of the cleaning blade or elastic roller is stopped, lowered in speed, or otherwise changed during the image forming process. However, in some cases, for example, where the image contains a large amount of white area so that less toner is used, the reciprocating motion of the cleaning means may be stopped or lowered in speed or may be carried out only when required, or may even be raised in the speed.

As described above, according to this invention, it becomes possible to reciprocate the cleaning means with respect to the image bearing member for satisfactory cleaning, while inhibiting the image bearing member from being subjected to vibrations caused by the reciprocating motion as much as possible. This invention can also provide a satisfactory image with no image blurs by inhibiting the occurrence of vibrations of the image bearing member.

What is claimed is:

1. An image forming apparatus comprising:
a moving image bearing member;
latent image forming means for forming a latent image on the surface of said image bearing member;
development means for developing the latent image formed by said latent image forming means;
cleaning means held into contact with said image bearing member for cleaning the surface of said image bearing member;
reciprocating means for reciprocating said cleaning means transverse to the direction of movement of said image bearing member; and
control means for controlling operation of said reciprocating means;
said control means being constructed and arranged to change the reciprocating motion of said cleaning means effected by said reciprocating means with respect to said bearing member during a period other than that in which the latent image is formed on said image bearing member.

2. An image forming apparatus according to claim 1, wherein said control means changes the status of reciprocating motion of said cleaning means effected by said reciprocating means with respect to said image bearing member during the period other than that in which the latent image is formed on said image bearing member and the latent image is then developed.

3. An image forming apparatus according to claim 2, wherein said apparatus includes transfer measn for transferring the image on the surface of said image bearing member to a transfer material, and said control means changes the status of reciprocating motion of said cleaning means effected by said reciprocating means with respect to said image bearing member during the period other than that in which the latent image is formed on said image bearing member and the latent image is then developed and transferred.

4. An image forming apparatus according to claim 1, wherein said cleaning means includes at least one of a blade and a rotatable roller.

5. An image forming apparatus according to claim 1, wherein said control means is constructed and arranged to change at least one of the reciprocating stroke and the reciprocating speed of said cleaning means with respect to said image bearing member during a period other than that in which a latent image is formed on said image bearing member.

6. An image forming apparatus according to claim 5, wherein said control means is constructed and arranged to increase the reciprocating speed of said cleaning means effected by said reciprocating means during a period other than that in which a latent image is formed on said image bearing member, whereby the increased reciprocating speed of said cleaning means during said other period is greater than the reciprocating speed of said cleaning means during the period in which the latent image is formed on said image bearing member.

7. An image forming apparatus according to claim 5, wherein said control means is constructed and arranged to shorten the reciprocating stroke of said cleaning means effected by said reciprocating means during a period other than that in which a latent image is formed on said image bearing member, whereby the decreased reciprocating stroke of said cleaning means during said other period is less than the reciprocating stroke of said cleaning means during the period in which the latent image is formed on said image bearing member.

8. An image forming apparatus according to claim 1, wherein said image bearing member includes a photosensitive layer on a surface thereof, and wherein said latent image forming means includes light irradiation means for irradiating a light beam onto said photosensitive layer of said image bearing member in response to image information.

9. An image forming apparatus according to claim 8, wherein said light irradiation means is arranged to irradiate a light beam onto said image bearing member in response to an electric signal produced in response to conversion of image information.

10. An image forming apparatus according to claim 9, wherein said light irradiation means is a laser beam scanner.

11. An image forming apparatus comprising:
a moving image bearing member;
latent image forming means for forming a latent image on the surface of said image bearing member;
development means for developing the latent image formed by said latent image forming means;
cleaning means held into contact with said image bearing member for cleaning the surface of said image bearing member;
reciprocating means for reciprocating said cleaning means transverse to the direction of movement of said image bearing member; and
control means for controlling operation of said reciprocating means;
said control means being constructed and arranged to stop said reciprocating means at least during a period in which the latent image is formed on said image bearing member.

12. An image forming apparatus according to claim 11, wherein said control means stops said reciprocating means at least during the period in which the latent image is formed on said image bearing member and the latent image is then developed.

13. An image forming apparatus according to claim 11, wherein said apparatus includes transfer means for transferring the image on the surface of said image bearing member to a transfer material, and said control means stops said reciprocating means at least during the period in which the latent image is formed on said image bearing member and the latent image is then developed and transferred.

14. An image forming apparatus according to claim 11, wherein said cleaning means includes at least one of a blade and a rotatable roller.

15. An image forming apparatus according to claim 11, wherein said image bearing includes a photosensitive layer on a surface thereof, and wherein said latent image forming means includes light irradiation means for irradiating a light beam onto said photosensitive layer of said image bearing member in response to image information.

16. An image forming apparatus according to claim 15, wherein said light irradiation means is arranged to irradiate a light beam onto said image bearing member in response to an electric signal resulting from conversion of image information.

17. An image forming apparatus according to claim 16, wherein said light irradiation means is a laser beam scanner.

18. An image forming apparatus comprising:

a moving image bearing member;

latent image forming means for forming a latent image on surface of said image bearing member;

development means for developing the latent image formed by said latent image forming means;

cleaning means held in contact with said image bearing member for cleaning the surface of said image bearing member;

moving means for moving said cleaning means with respect to said image bearing member while said cleaning means is kept is contact with said image bearing member; and changing means for changing movement of said cleaning means effected by said moving means, said changing means being constructed and arranged to change the movement of said cleaning means effected by said moving means with respect to said image bearing member during a period other than that in which the latent image is formed on said image bearing member.

19. An image forming apparatus according to claim 18, wherein, after said changing means changes the movement of said cleaning means effected by said changing means with respect to said image bearing member during the period other than that in which the latent image is formed on said image bearing member, the latent image is developed.

20. An image forming apparatus according to claim 19, further comprising transfer means for transferring the image on the surface of said image bearing member to a transfer material, and wherein, after said changing means changes the movement of said cleaning means effected by said changing means with respect to said image bearing member during the period other than that in which the latent image is formed on said image bearing member, the latent image is developed and transferred.

21. An image forming apparatus according to claim 18, wherein said cleaning means includes at least one of a blade and a rotatable roller.

22. An image forming apparatus according to claim 18, wherein said changing means changes the moving speed of said cleaning means with respect to said image bearing member during the period other than that in which the latent image is formed on said image bearing member.

23. An image forming apparatus according to claim 22, wherein said changing means is constructed and arranged to increase speed of the movement of said cleaning means effected by said moving means during a period other than that in which a latent image is formed on said image bearing member, such that the increased speed of movement of said cleaning means during said period is greater than the speed of movement of said cleaning means during the period in which the latent image is formed on said image bearing member.

24. An image forming apparatus according to claim 18, wherein said image bearing member includes a photosensitive layer on a surface thereof, and wherein said latent image forming means includes light irradiation means for irradiating a light beam onto said image bearing member in response to image information.

25. An image forming apparatus according to claim 24, wherein said moving means is reciprocating means for reciprocating said cleaning means transverse to a direction of motion of said image bearing member.

26. An image forming apparatus according to claim 24, wherein said light irradiation means is arranged to irradiate a light beam onto said image bearing member in response to an electric signal produced in response to conversion of image information.

27. An image forming apparatus according to claim 26, wherein said light irradiation means is a laser beam scanner.

* * * * *

UNITED STATES PATENT AND TRADEMARK OFFICE

CERTIFICATE OF CORRECTION

PATENT NO. : 4,982,239 Page 1 of 2

DATED : January 1, 1991

INVENTOR(S) : KUME, ET AL.

It is certified that error appears in the above-identified patent and that said Letters Patent is hereby corrected as shown below:

Title Page:

AT [30] Foreign Application Priority Data:

Jul. 22, 1988 [JP] Japan . . . . 63-184095 should read --Jul. 22, 1988 [JP] . . . . 63-184195--.

COLUMN 1

Line 21, "necessary each" should read --necessary. Each--.
Line 39, "Secondly" should read --Secondly,--.

COLUMN 3

Line 27, "arrow a," should read --arrow A,--.

COLUMN 4

Line 25, "humidity. FIG. 5" should read --humidity. ¶FIG. 5.--.

COLUMN 5

Line 12, "elastic the" should read --the elastic--.
Line 29, "performed" should be deleted.
Line 31, "(FIG. 2) to another cam 12'" should read --to another cam 12' (FIG. 12)--.
Line 41, "12');" should read --12'),--.

UNITED STATES PATENT AND TRADEMARK OFFICE

CERTIFICATE OF CORRECTION

PATENT NO. : 4,982,239

DATED : January 1, 1991

INVENTOR(S) : KUME, ET AL.

It is certified that error appears in the above-identified patent and that said Letters Patent is hereby corrected as shown below:

COLUMN 7

Line 32, "bearing member" should read --image bearing member--.

Line 43, "measn" should read --means--.

Signed and Sealed this

Eighth Day of September, 1992

*Attest:*

*Attesting Officer*

DOUGLAS B. COMER

*Acting Commissioner of Patents and Trademarks*